US006606813B1

(12) United States Patent
Squire et al.

(10) Patent No.: US 6,606,813 B1
(45) Date of Patent: Aug. 19, 2003

(54) WEAPON ACCESSORY MOUNTING APPARATUS

(75) Inventors: Mark D. Squire, San Diego, CA (US); Petras V. Avizonis, Jr., Carlsbad, CA (US); Attilio Gerald Scotese, Mammoth Lakes, CA (US); Todd David Carey, Ventura, CA (US)

(73) Assignee: Exponent, Inc., Menlo Park, CA (US)

( * ) Notice: Subject to any disclaimer, the term of this patent is extended or adjusted under 35 U.S.C. 154(b) by 0 days.

(21) Appl. No.: 10/092,543

(22) Filed: Mar. 8, 2002

(51) Int. Cl.[7] ..... F41C 27/00

(52) U.S. Cl. ..... 42/90; 42/111; 42/123; 248/201; 248/205.1; 248/298.1

(58) Field of Search ..... 248/201, 205.1, 248/298.1; 42/90, 111, 123

(56) References Cited

U.S. PATENT DOCUMENTS

| | | | | | |
|---|---|---|---|---|---|
| 3,671,000 | A | | 6/1972 | Williams | 248/205 |
| 3,734,437 | A | | 5/1973 | Underwood | 248/205 |
| 3,880,389 | A | | 4/1975 | Burris | 248/205 |
| 3,986,285 | A | * | 10/1976 | Krisay | 42/127 |
| 4,733,489 | A | * | 3/1988 | Kurak | 42/77 |
| 4,742,636 | A | * | 5/1988 | Swan | 42/126 |
| 4,845,871 | A | * | 7/1989 | Swan | 42/127 |
| 5,142,806 | A | * | 9/1992 | Swan | 42/114 |
| 5,155,292 | A | * | 10/1992 | Rostcil et al. | 89/167 |
| 5,198,600 | A | * | 3/1993 | E'Nama | 42/90 |
| 5,276,988 | A | * | 1/1994 | Swan | 42/127 |
| 5,343,650 | A | * | 9/1994 | Swan | 42/117 |
| 5,425,191 | A | | 6/1995 | Taylor et al. | 42/101 |
| 5,467,552 | A | | 11/1995 | Cupp et al. | 42/100 |
| 5,531,039 | A | | 7/1996 | Gore | 42/101 |
| 5,533,292 | A | * | 7/1996 | Swan | 42/123 |
| 5,584,137 | A | | 12/1996 | Teetzel | 42/103 |
| 5,590,484 | A | | 1/1997 | Mooney et al. | 42/100 |
| 5,606,818 | A | * | 3/1997 | Hardee | 42/124 |
| 5,669,174 | A | | 9/1997 | Teetzel | 42/103 |
| 5,680,725 | A | * | 10/1997 | Bell | 42/127 |
| 5,691,497 | A | * | 11/1997 | Weichert et al. | 89/1.4 |
| 5,787,630 | A | * | 8/1998 | Martel | 42/125 |
| 5,806,228 | A | | 9/1998 | Martel et al. | 42/101 |
| 5,896,850 | A | * | 4/1999 | Sullivan, Jr. | 124/74 |
| 5,941,489 | A | | 8/1999 | Fanelli et al. | 248/298.1 |
| 6,000,667 | A | | 12/1999 | Isbell et al. | 248/201 |
| 6,073,895 | A | | 6/2000 | Isbell et al. | 248/201 |
| D448,062 | S | * | 9/2001 | Criddle et al. | D22/110 |
| 6,381,895 | B1 | * | 5/2002 | Keeney et al. | 42/124 |
| 6,385,892 | B1 | * | 5/2002 | Vendetti | 42/86 |
| 6,421,946 | B1 | * | 7/2002 | LoRocco | 42/111 |
| 6,442,883 | B1 | * | 9/2002 | Waterman et al. | 42/124 |

FOREIGN PATENT DOCUMENTS

| | | | |
|---|---|---|---|
| DE | 004121178 A | * | 1/1993 |
| WO | WO93/20398 | * | 10/1993 |

* cited by examiner

*Primary Examiner*—Michael J. Carone
*Assistant Examiner*—John Richardson
(74) *Attorney, Agent, or Firm*—Hall, Priddy, Myers & Vande Sande

(57) ABSTRACT

Apparatus for mounting optical sights or other weapon accessories which locates the weapon accessories (e.g. optical sights, laser range finders, night scopes, etc.) at a reduced distance relative to the position of the barrel of a weapon.

23 Claims, 7 Drawing Sheets

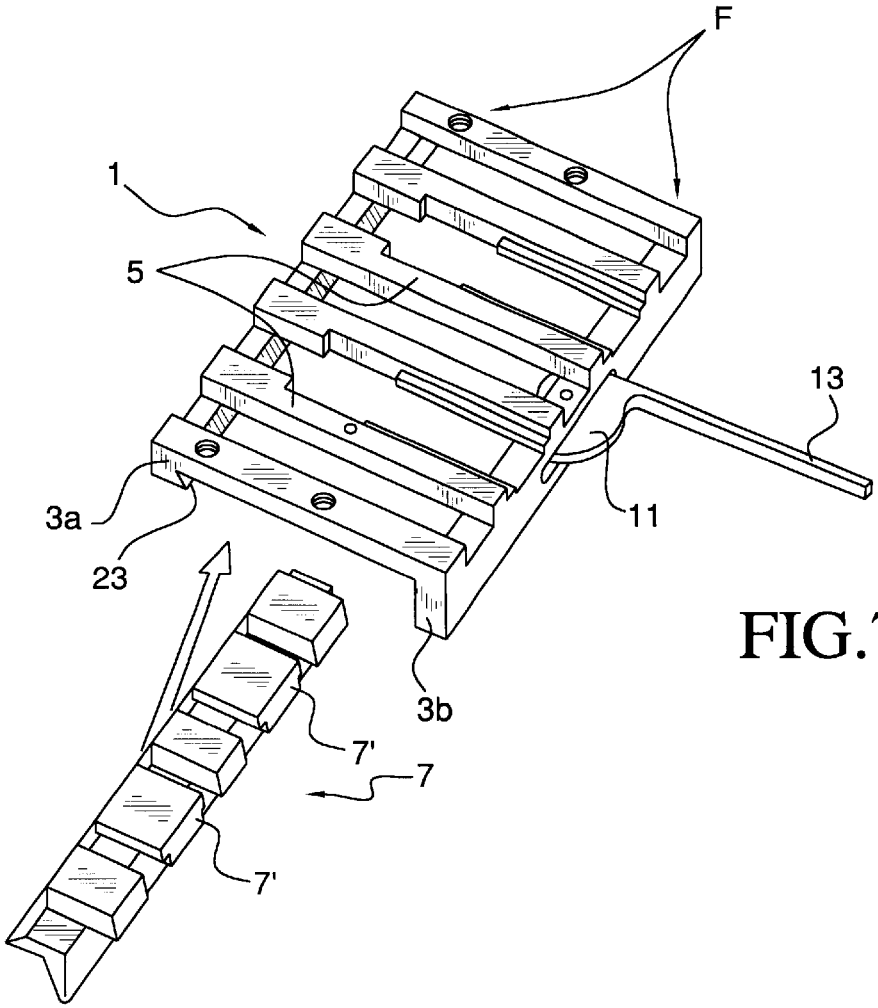
FIG.7
FIG.8
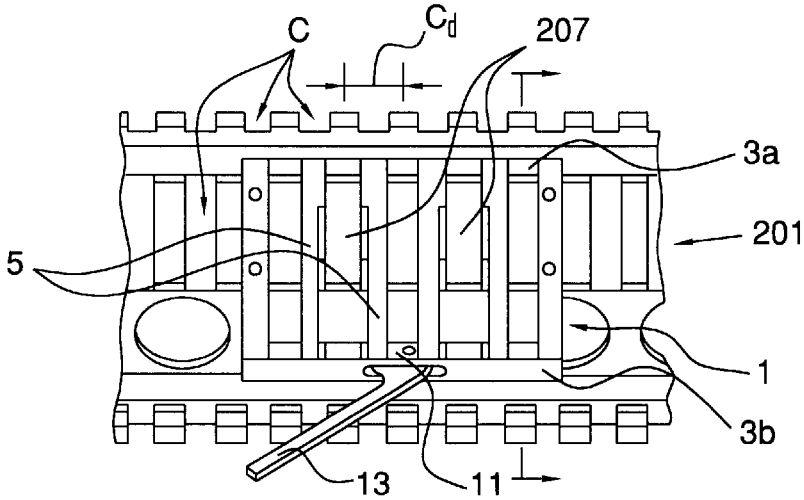

WEAPON ACCESSORY MOUNTING APPARATUS

FIELD OF INVENTION

This invention relates to apparatus for mounting optical sights or other weapon accessories. More specifically, this invention relates to apparatus for mounting weapon accessories (e.g. optical sights, laser range finders, night scopes, etc.) at a reduced distance relative to the position of the barrel of a weapon.

BACKGROUND OF THE INVENTION

Universal weapon mounts, such as the conventional and well known MIL-STD Picatinny weapon mount, are prolifically employed in the mounting of accessories (e.g. laser or optical sights, or laser range finders) on weapons for military and special unit police type operations. These mounts are conventionally attached proximal a midpoint of a weapon in order to provide a standardized mounting substrate to which various weapon accessories may be selectively attached. It is typical, in this regard, that a weapon accessory not be attached directly to the universal weapon mount which is being employed. Instead, a mount adaptor is normally utilized which is attachable to a weapon accessory at one surface and to a conventional universal weapon mount (e.g. the Picatinny mount) at a standardized second surface.

Typical universal weapon mounts conventionally comprise a body having a seating surface which is shaped to conform to a mounting area of a weapon (e.g. the barrel) so that it may be secured integral thereto. On an opposite (normally upward or sideways facing) surface, the universal weapon mount body conventionally includes four longitudinally extending rail structures (i.e. rails). These rail structures are provided so that accessories, typically optical or laser sights for example, may be mounted to the universal weapon mount using mount adaptor devices which are able to grip the sides or edges of the rails. Each rail structure, in turn, has located thereon a plurality of ribs extending perpendicular along each rail structures length. The ribs, which are often provided with visual location indicia (e.g. numbers or letters), provide a reference point so that specific locations may be reliably and repeatably located along the rail (e.g. the mounting location to which an optical sight is bore sighted).

As aforesaid, mount adaptor devices are typically employed because a weapon accessory (e.g. optical sight, laser sight or night vision sight) is ordinarily not designed for direct attachment to the rails of universal weapon mount systems. When employed, however, these mount adaptors, because of their thickness and the manner in which they attach to the universal weapon mount rails, normally raise the position of the accessory relative to the body or the barrel of the weapon. This presents a variety of problems.

When employing optical sights, for example, any increase in distance of the sight from the bore of the barrel of the weapon increases the probability that parallax sighting errors will occur. This increases the difficulty of sighting the weapon and reduces the weapon user's targeting efficiency in combat scenarios. In addition, when any type of accessory is employed in a raised position on a weapon, such accessory is vulnerable to impacts with objects in the field and is additionally susceptible to snags on branches, brush, or barbed wire for example.

In view of the foregoing, it is apparent that there exists a need in the art for weapon accessory mount apparatus which overcomes, mitigates, or solves the above problems in the art. It is a purpose of this invention to fulfill this and other needs in the art which will become more apparent to the skilled artisan once given the following disclosure.

SUMMARY OF THE INVENTION

Generally speaking, this invention fulfills the above-described needs in the art by providing: a mount apparatus for mounting a weapon accessory to a universal weapon mount having at least one rail, the at least one rail including a plurality of ribs disposed thereon, the plurality of ribs defining a plurality of spaces comprising channels, each channel having a width and a depth, and each channel being spaced a distance $C_d$ from the adjacent channel; the mount apparatus comprising:

a frame comprising a first longitudinal frame member and a second longitudinal frame member, the first longitudinal frame member being spaced from the second longitudinal frame member; and the first longitudinal frame member including a rail engaging surface;

means for attaching a weapon accessory to the mount apparatus;

biasing means operable to bias the rail engaging surface against a first rail surface of a universal weapon mount; and at least one cross member which connects the first longitudinal frame member to the second longitudinal frame member; the at least one cross member being a size and so oriented such that the cross member nests substantially within the width and depth of a channel of a universal weapon mount when the mount apparatus is attached to the universal weapon mount.

In a further embodiment there is provided: a mount apparatus for mounting a weapon accessory to a universal weapon mount having at least one rail, the at least one rail including a plurality of ribs disposed thereon, the plurality of ribs defining a plurality of spaces comprising channels, each channel having a width and a depth, and each channel being spaced a distance $C_d$ from the adjacent channel; the mount apparatus comprising:

a frame comprising a first longitudinal frame member and a second longitudinal frame member, the first longitudinal frame member being spaced from the second longitudinal frame member;

means for attaching a weapon accessory to the mount apparatus;

biasing means operable to attach the mount apparatus to a universal weapon mount; and at least one cross member which connects the first longitudinal frame member to the second longitudinal frame member; the at least one cross member being a size and so oriented such that the cross member nests substantially within the width and depth of a channel of a universal weapon mount when the mount apparatus is attached to the universal weapon mount.

This invention will now be described with respect to certain embodiments thereof as illustrated in the following drawings wherein:

BRIEF DESCRIPTION OF THE DRAWINGS

FIG. 7 is a three-dimensional blown apart view illustrating the detail of the biasing member of the mount adaptor according to FIG. 5

FIG. 8 is a top schematic view of one embodiment of the mount adaptor according to the subject invention shown installed on the Picatinny weapon mount illustrated in FIG. 1.

DETAILED DESCRIPTION OF CERTAIN EMBODIMENTS

Figure 1:
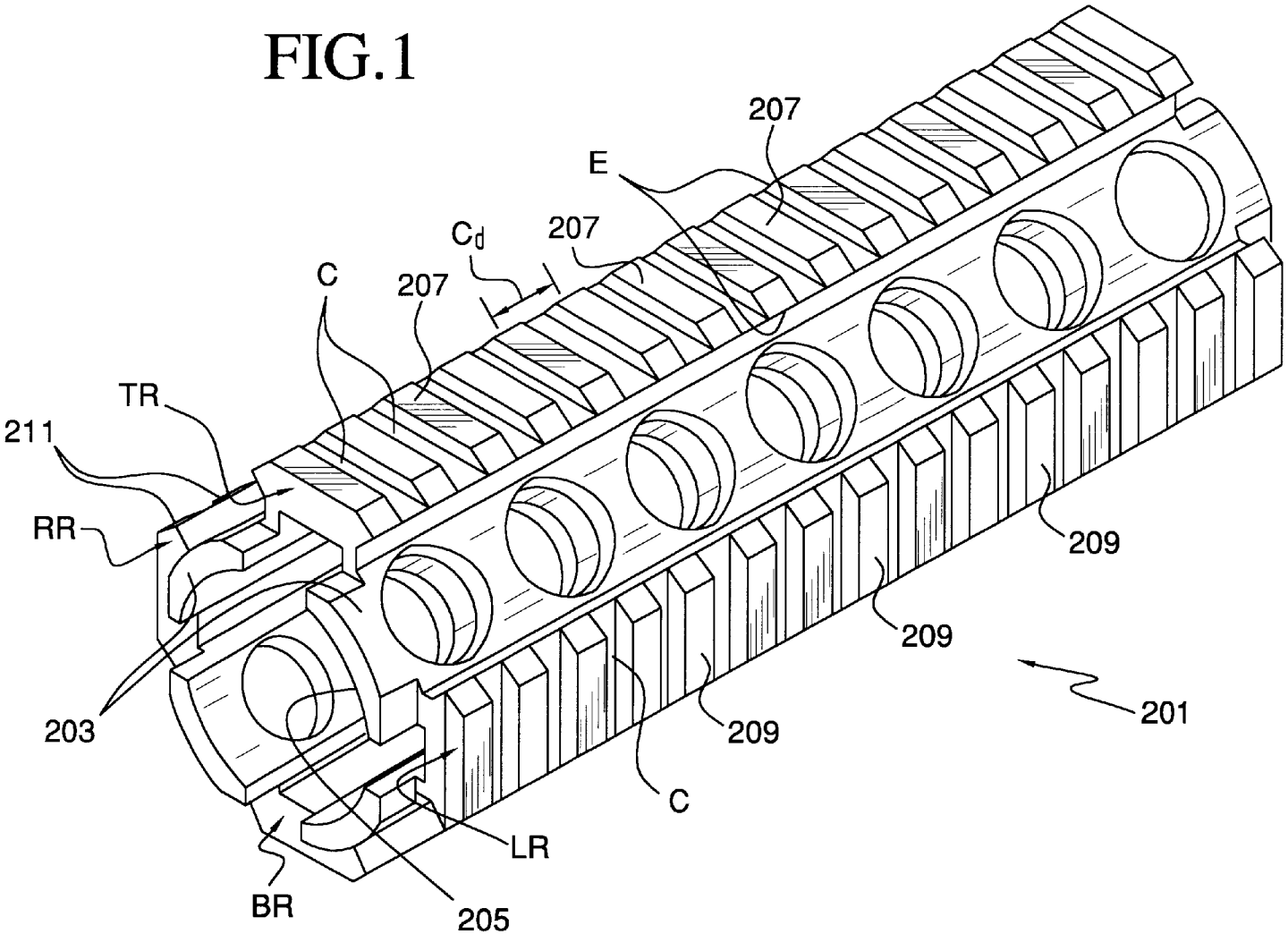
FIG. 1 is a three-dimensional view of a conventional MIL-STD Picatinny universal weapon mount.

Referring initially to FIG. 1 therein is illustrated a conventional universal weapon mount 201 as is employed prolifically in the art. As such, weapon mount 201 conventionally comprises a mount body 203 having both weapon and accessory mounting surfaces respectively (weapon mounting surface 205 being purely conventional in nature and thus not described herein). The accessory mounting surface of weapon mount 201 comprises three rails TR, LR, RR, and BR (bottom rail BR typically being covered or replaced by a heat shield) extending longitudinally on the top, left, and right surfaces of the outward facing portion of mount body 203 respectively. Each rail structure, in turn, includes a plurality of rib structures 207, 209, and 211 which are separated from each other by a distance $C_d$ and which extend perpendicular to the length of each rail respectively and form channels "C". In use, each rail TR, LR, and RR serves as a mounting surface to which a weapon accessory may be attached as will be described in more detail below.

Figure 2:
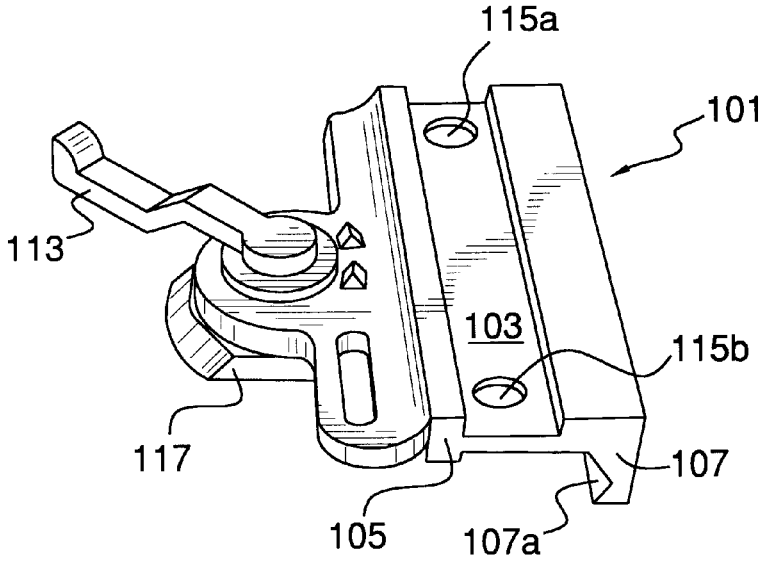
FIG.2 PRIOR ART
FIG. 2 is a three-dimensional top view of a prior art mount adaptor.
Figure 3:
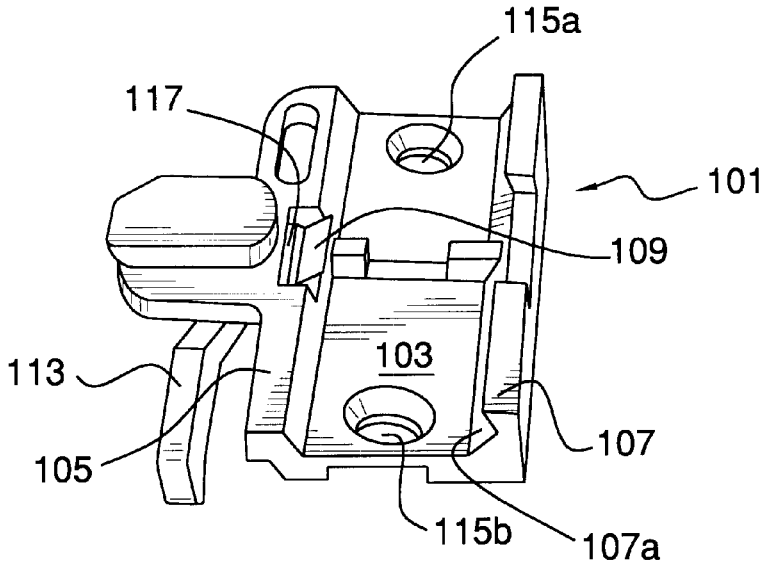
FIG.3 PRIOR ART
FIG. 3 is a three-dimensional bottom view of the prior art mount adaptor illustrated in FIG. 2.
Figure 4:
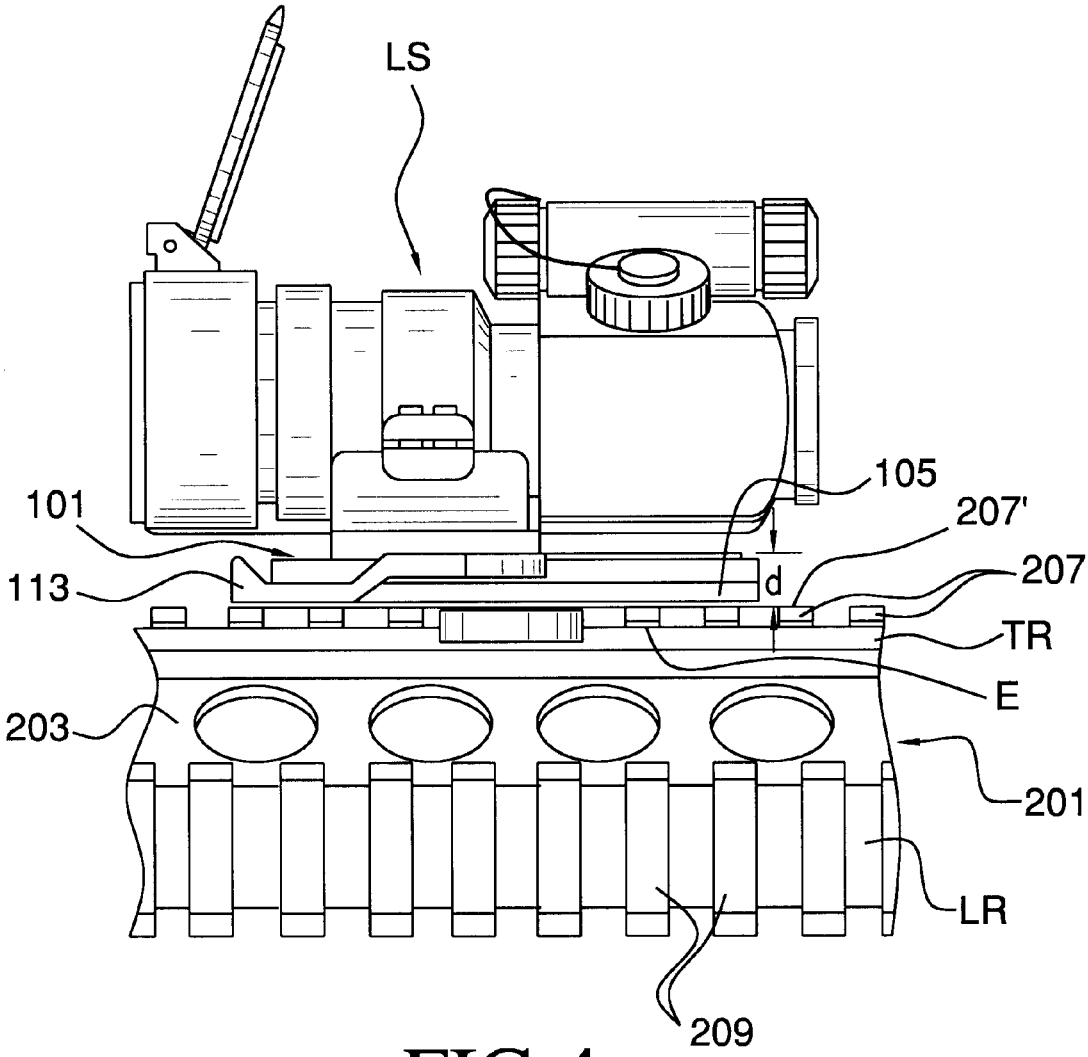
FIG.4 PRIOR ART
FIG. 4 is a side plan view of the prior art mount adaptor according to FIG. 2 having a conventional laser sight mounted thereon and shown attached to the Picatinny weapon mount illustrated in FIG. 1.
Figure 5:
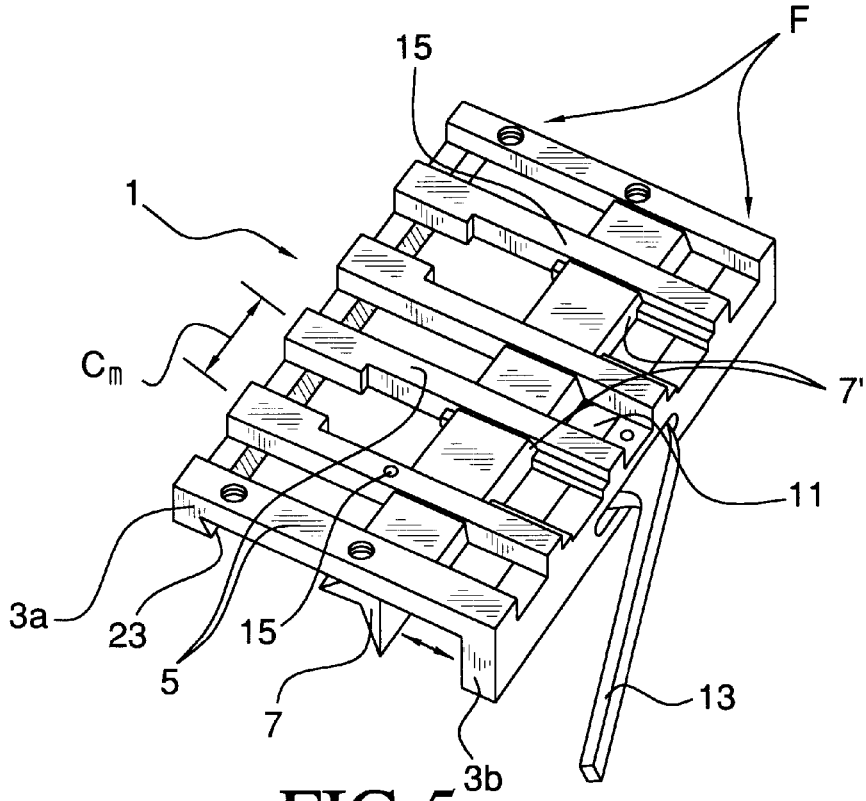
FIG. 5 is a three-dimensional top view of one embodiment of the mount adaptor according to the subject invention.
Figure 6:
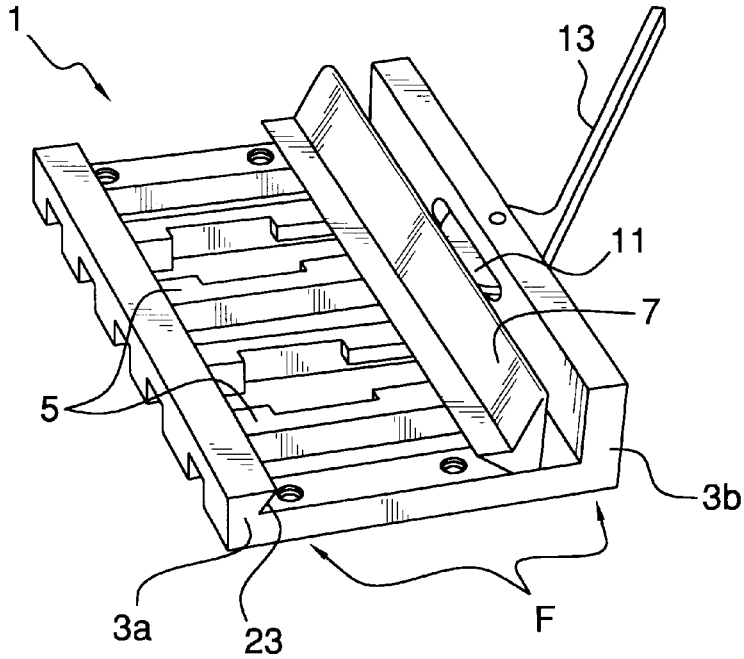
FIG. 6 is a three-dimensional bottom view of the mount adaptor illustrated in FIG. 5.
Figure 9:
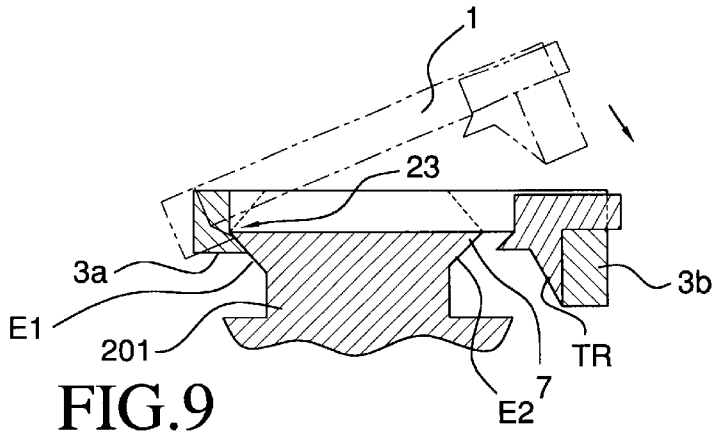
FIG. 9 is a schematic end view illustrating the beginning of the installation procedure for one embodiment of the inventive mount adaptor on a conventional Picatinny weapon mount.
Figure 10:
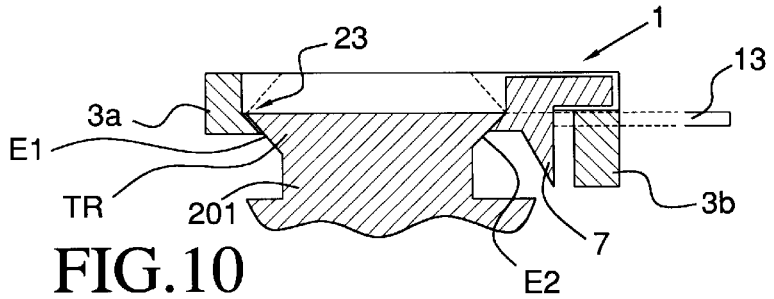
FIG. 10 is a schematic end view of the end of the installation procedure illustrated in FIG. 9.

Referring now to FIGS. 2–4, a prior art mount adaptor commonly employed for mounting a weapon accessory to a universal weapon mount 201 is illustrated therein. As shown, mount adaptor 101 comprises a planar body 103 framed by side rails 105 and 107. Side rail 107 includes a beveled edge forming a groove 107*a* which is engagable with an edge of a rail TR, LR, or RR (see FIG. 1). Frame member 105 includes a recess through which a surface of cam 117 communicates with a biasing plate 109 in order to selectively bias the biasing plate against a surface of universal weapon mount 201 when mount adaptor 101 is mounted thereon. More specifically, cam 117 may be operated via lever 113 to bias plate 109 against an edge "E" (see FIG. 1) of a rail (TR, LR, or RR) such that biasing plate 109 and groove 107*a* clamp on to the respective rail and secure mount adaptor 101 thereon.

Therefore, in order to attach prior art adaptor 101 to a rail such as rail TR of universal mount 201 (see FIG. 4), mount adaptor 101 is simply placed so that planar body 103 is resting on the top surface 207' of ribs 207 such that rails 105 and 107 are positioned along the opposing sides of rail TR. Once in position as such, lever 113 may be operated to engage cam 117 against plate 109 thereby biasing plate 109 against the side edge surface "E" of rail TR (or LR or RR). Simultaneously, operation of cam 117 (via lever 113) engages groove 107*a* to the opposite edge "E" of rail TR thus firmly securing mount adaptor 101 in place on top of rail TR.

In typical situations, of course, a weapon accessory, such as laser sight LS (see FIG. 4) for example, will have been previously secured to the mount adaptor 101, and apertures 115*a* and 115*b* are provided (see FIGS. 2 & 3), in this regard, so that screws (or other conventional means) may be employed to accomplish such purpose. Thus, once mount adaptor 101 is secured to rail TR as in the previous example, the weapon accessory will be securely fixed to the universal weapon mount by the operation of the adaptor.

As may be seen clearly in FIG. 4, however, when mount adaptor 101 is attached to weapon mount 201, the uppermost surface of mount adaptor 101 (to which weapon accessories are attached) is located at a height above weapon mount 201 (indicated by distance "d" in FIG. 4) which is equal to the thickness of mount adaptor 101. Therefore, any accessory which is attached employing such an adaptor is raised above the surface of universal weapon mount 201 to a distance which is equal to the numerical value "d". This height "d", in turn, is the source of the problems attendant the use of such prior art mount adaptors and is illustrative of the deficiencies of the prior art which the present invention overcomes.

Overcoming these prior art problems by providing the ability to mount weapon accessories (e.g. laser sight "LS", optical sights, night vision, etc.) at a reduced height relative to that of prior art mount adaptors, is the unique flush mount apparatus of the present invention. One embodiment of the inventive flush mount apparatus is illustrated in FIGS. 5–11.

As illustrated in FIGS. 5–11, unique mount apparatus 1 comprises a frame "F" having two longitudinal frame members 3*a* and 3*b* and a plurality of cross-members 5 which span between the frame members thus connecting them, which define a plurality of longitudinal openings. In particular, cross-members 5 are spaced a distance $C_m$ (see FIG. 5) from each other which is substantially equal to the distance $C_d$ between the channels C of universal weapon mount 201 (see FIGS. 1 & 8). Similarly, cross members 5 are sized to fit within channels C so that they may nest therein when mount apparatus 1 is installed on mount 201.

Figure 11:
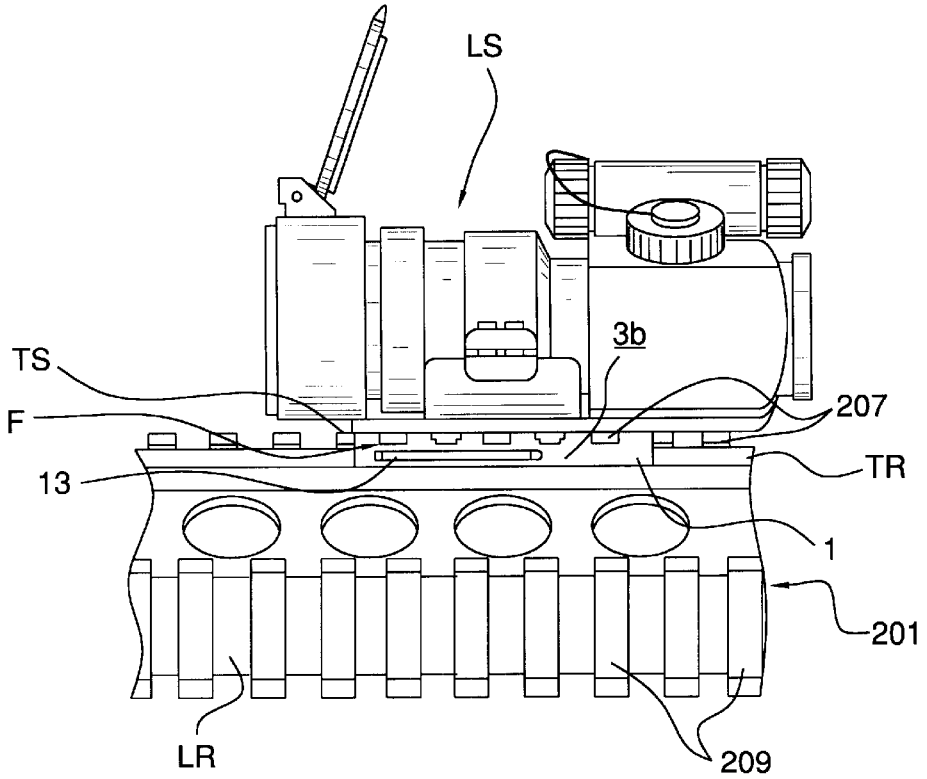
FIG. 11 is a side plan view of the mount adaptor according to FIG. 5 having a conventional laser sight mounted thereon and shown attached to the Picatinny weapon mount illustrated in FIG. 1.

In particular, it is the combination of these two features which permits mount apparatus 1 to achieve its improved results. In this regard, because each of cross members 5 is sized and spaced as such, each cross member 5, when mount apparatus 1 is installed on a universal mount 201 (as will be described below), fits entirely within one of the channels C created by the spacing of ribs 207, 209, or 211 (see FIGS. 8 and 11). Therefore, when mount apparatus 1 is attached to universal mount 201, the "highest" surface of frame "F" of mount apparatus 1 is located substantially flush with the top surface "TS" of ribs 207 (or 209 or 211 when installed thereto). Thus, for example, when mount apparatus 1 is employed to mount a laser sight "LS" such as illustrated in FIG. 11 (attached to mount apparatus 1 via screw members or other conventional means not shown herein), the height of the sight relative to the position of the weapon is no greater than would be the case if the laser sight were mounted directly to universal mount 201 (i.e. not employing any mount adaptor). In this way, the undesirable distance "d" of the prior art, which is illustrated in FIG. 4, is effectively eliminated (i.e. reduced substantially to zero) and the efficacy of mounting optical sights or other weapon accessories is thus greatly improved.

Although the accompanying Figures illustrate mount apparatus 1 as including six cross-members 5, other embodiments are contemplated where larger or smaller numbers of cross-members are employed (only 1 being necessary). Similarly, various mechanisms are contemplated for use by which mount apparatus 1 may be "locked" onto a universal weapon mount at a rail surface. In the embodiment illustrated in FIGS. 5–11, for example, longitudinal frame member 3*a* includes a beveled edge which forms a groove 23. Further included as part of a means for locking mount apparatus 1 to a rail surface is biasing member 7. Biasing member 7, in the illustrated embodiment, is a beveled plate member having T-shaped head members 7' (see FIG. 7) which engage with cross members 5. Engaged as such with the cross members, biasing member 7 is able to travel back and forth along their lengths while simultaneously being secured thereto.

Still further provided as part of the locking mechanism are cam member 11 and lever 13. Lever 13 is attached to cam member 11 (which is pivotally attached to longitudinal frame member 3*b*) and, when operated, causes the elliptical surface of cam member 11 to contact biasing member 7 and therefore bias it in a direction towards groove 23.

In certain embodiments contemplated by this invention (see FIG. 5), pin(s) 15 may be optionally provided to limit the movement of biasing member 7 along the lengths of cross members 5. More particularly, these optional pins may be used when it is desired to ensure that biasing member 7 is always oriented in an "install ready" position with a minimum preset gap between biasing member 7 and groove 23 (i.e. so that minimal or no manual manipulation of biasing member 7 is required for attachment to a mount surface).

Turning now to the operation of the subject invention, once mount apparatus 1 is placed on universal weapon mount 201 (see FIGS. 9 & 10) and cross members 5 are aligned and nested within the spaces or channels C between ribs 207, 209, or 211 (see FIGS. 8 & 11), apparatus 1 may be locked in place by the simple operation of lever 13. In particular, operation of the lever, when mount apparatus 1 is in place on universal mount 201, causes cam 11 to act on biasing member 7 such that biasing member 7 is pressed with adequate force against the beveled undersurface E2 of the universal weapon mount. This action simultaneously brings edge E1 into tight engagement with groove 23 (see FIG. 10) thus fixing mount apparatus 1 securely at the desired location along the rail.

Figure 12:
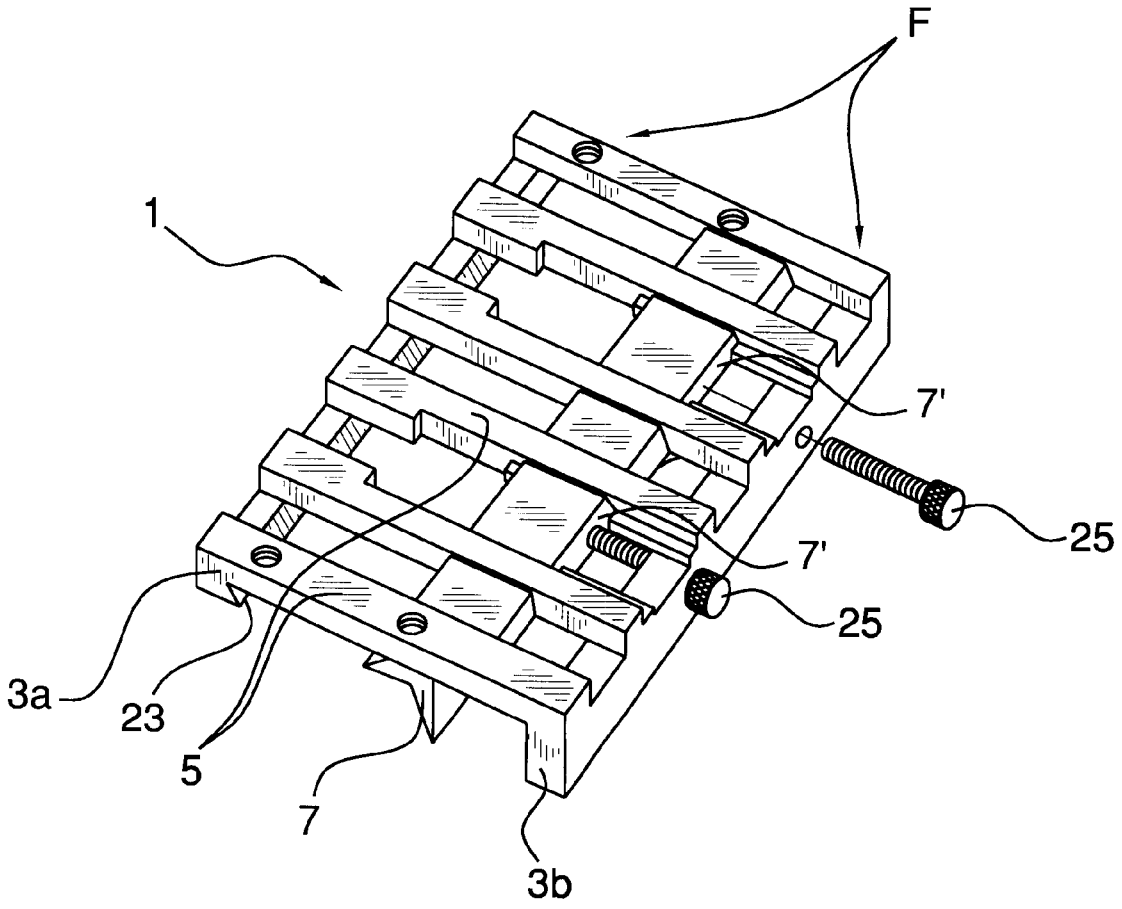
FIG. 12 is a three-dimensional top view of an alternative embodiment of the mount adaptor according to the subject invention.

Other operative alternatives to cam 11 and lever 13 are contemplated. One such alternative is illustrated in FIG. 12. As illustrated, in this alternative embodiment, threaded members 25 are employed in order to act on biasing member 7 during the attachment of mount apparatus 1.

Once given the above disclosure, many other features, modifications, and improvements will become apparent to the skilled artisan. Such other features, modifications, and improvements are therefore considered to be a part of this invention, the scope of which is to be determined by the following claims.

We claim:

1. A mount apparatus for mounting a weapon accessory to a weapon mounted rail system having at least one rail, the at least one rail including a plurality of ribs disposed thereon, the plurality of ribs defining a plurality of spaces comprising channels, each channel having a width and a depth, and each channel being spaced a distance $C_d$ from the adjacent channel; the improvement wherein said mount apparatus comprises:

a frame comprising a first longitudinal frame member and a second longitudinal frame member, said first longitudinal frame member being spaced from said second longitudinal frame member; and said first longitudinal frame member including a rail engaging surface;

means for attaching a weapon accessory to said mount apparatus;

biasing means operable to bias said rail engaging surface against a first rail surface of said weapon mounted rail system; and a plurality of cross members connecting said first longitudinal frame member to said second longitudinal frame member, said plurality of cross members defining a plurality longitudinal openings located there between, said openings extending a distance substantially between said first longitudinal frame member and said second longitudinal frame member, each said opening being so shaped such as to be capable of accepting one of the plurality of ribs of said weapon mounted rail system.

2. The mount apparatus according to claim 1 further including a biasing member which is movable along an axis of said at least one cross member; and wherein said biasing means is capable of biasing said biasing member against a second rail surface of the weapon mounted rail system.

3. The mount apparatus according to claim 2 wherein said rail engaging surface of said first longitudinal frame member comprises a first beveled surface for engagement with the first rail surface of the weapon mounted rail system.

4. The mount apparatus according to claim 3 wherein said biasing member includes a second beveled surface for engagement with the second rail surface of the weapon mounted rail system.

5. The mount apparatus according to claim 4 wherein said mount apparatus includes at least two cross members.

6. The mount apparatus according to claim 4 wherein when said biasing means is operated, said biasing means biases said biasing member in a direction along an axis of said cross member.

7. The mount apparatus according to claim 1 wherein said biasing means comprises a threaded member cooperatively engaged to a threaded aperture located in one of said first or said second longitudinal frame members.

8. The mount apparatus according to claim 1 wherein said biasing means comprises an elliptical cam member having a lever member attached thereto, said lever member being operable to engage a surface of said elliptical cam member to a second rail surface of the weapon mounted rail system.

9. The mount apparatus according to claim 6 wherein said biasing means comprises an elliptical cam member having a lever member attached thereto, said lever member being operable to engage a contacting surface of said elliptical cam member to a surface of said biasing member thereby to bias said biasing member in said direction along an axis of said cross member.

10. The mount apparatus according to claim 5 wherein said at least two cross members are spaced a distance $C_m$ apart from one another which is substantially equal to the distance $C_d$ between the channel members of the weapon mounted rail system.

11. The mount apparatus according to claim 10 wherein the number of said cross members is selected from a number between 3–7 and wherein each of said cross members is spaced a distance $C_m$ from the adjacent cross member.

12. In combination, a universal weapon mount and the mount apparatus according to claim 1, wherein when said mount apparatus is attached to the weapon mounted rail system, said at least one cross member is located within one of said channels.

13. The combination of claim 12 wherein said mount apparatus further includes a biasing member which is movable along an axis of said at least one cross member; and wherein said biasing means is capable of biasing said biasing member against a second rail surface of the weapon mounted rail system.

14. The combination of claim 13 wherein said rail engaging surface of said first longitudinal frame member comprises a first beveled surface for engagement with the first rail surface of the weapon mounted rail system.

15. The combination of claim 14 wherein said biasing member includes a second beveled surface for engagement with the second rail surface of the weapon mounted rail system.

16. The combination of claim 15 wherein when said biasing means is operated, said biasing means biases said biasing member in a direction along an axis of said cross member.

17. The combination of claim 16 wherein said biasing means comprises an elliptical cam member having a lever member attached thereto, said lever member being operable to engage a surface of said elliptical cam member to a surface of said biasing member thereby to bias said biasing member in said direction along an axis of said cross member.

18. The combination of claim 17 wherein said mount apparatus includes at least two cross members and wherein said at least two cross members are spaced a distance $C_m$ apart from one another which is substantially equal to the distance $C_d$ between the channel members of the weapon mounted rail system.

19. The mount apparatus according to claim 4 wherein said accessory attachment means comprises a threaded aperture for threadable communication with a threaded member such that said threaded member is capable of coupling said mount apparatus to a weapon accessory device.

20. A mount apparatus for mounting a weapon accessory to a weapon mounted rail system having at least one rail, the at least one rail including a plurality of ribs disposed thereon, the plurality of ribs defining a plurality of spaces comprising channels, each channel having a width and a depth, and each channel being spaced a distance $C_d$ from the adjacent channel; the improvement wherein said mount apparatus comprises:

a frame comprising a first longitudinal frame member and a second longitudinal frame member, said first longitudinal frame member being spaced from said second longitudinal frame member;

means for attaching a weapon accessory to said mount apparatus;

biasing means operable to attach said mount apparatus to said weapon mounted rail system; and a plurality of cross members connecting said first longitudinal frame member to said second longitudinal frame member, said plurality of cross members defining a plurality of longitudinal openings located there between, said openings extending a distance substantially between said first longitudinal frame member and said second longitudinal frame member, each said opening being so shaped such as to be capable of accepting one of the plurality of ribs of said weapon mounted rail system.

21. The mount apparatus according to claim 20 wherein said mount apparatus includes at least two cross members and wherein said at least two cross members are spaced a distance $C_m$ apart from one another which is substantially equal to the distance $C_d$ between the channel members of the weapon mounted rail system.

22. The mount apparatus according to claim 21 wherein the number of said cross members is selected from a number between 3–7 and wherein each of said cross members is spaced a distance $C_m$ from the adjacent cross member.

23. The mount apparatus according to claim 20 wherein said biasing means comprises an elliptical cam member having a lever member attached thereto, said lever member being operable to engage a surface of said elliptical cam member to a surface of the weapon mounted rail system thereby to secure said mount apparatus to the weapon mounted rail system.

* * * * *